US005289149A

United States Patent [19]

Nishita et al.

[11] Patent Number: 5,289,149

[45] Date of Patent: Feb. 22, 1994

[54] ELECTRON BEAM ADJUSTING DEVICE WITH MAGNET RINGS OF DIFFERING ALNICO POWDERED METAL CONTENT

[75] Inventors: Shigeo Nishita; Masatoshi Hirai, both of Mooka, Japan

[73] Assignee: Kanegafuchi Kagaku Kogyo Kabushiki Kaisha, Osaka, Japan

[21] Appl. No.: 849,371

[22] PCT Filed: Oct. 11, 1991

[86] PCT No.: PCT/JP91/01385

§ 371 Date: May 4, 1992

§ 102(e) Date: May 4, 1992

[87] PCT Pub. No.: WO91/01385

PCT Pub. Date: Oct. 11, 1991

[30] Foreign Application Priority Data

Oct. 11, 1990 [JP] Japan ..... 2-106949

[51] Int. Cl.[5] ..... H01J 29/54; H01F 1/02

[52] U.S. Cl. ..... 335/212; 335/210; 335/303

[58] Field of Search ..... 335/210, 212, 213, 214; 310/440; 358/248, 249

[56] References Cited

U.S. PATENT DOCUMENTS 4,030,126 6/1977 Puhak ..... 358/248

4,091,347 5/1978 Barbin ..... 335/212

4,670,726 6/1987 Ogata et al. ..... 335/212

FOREIGN PATENT DOCUMENTS 53-141499 12/1978 Japan .

56-156652 12/1981 Japan .

61-208726 9/1986 Japan .

*Primary Examiner*—Leo P. Picard

*Assistant Examiner*—Raymond Barrera

*Attorney, Agent, or Firm*—Armstrong, Westerman, Hattori, McLeland & Naughton

[57] ABSTRACT

The present invention relates to an electron beam adjusting device which is attached around the neck of a color picture tube, a CRT display, etc., and aims at providing an electron beam adjusting device in which each pair of constituent magnets can be readily magnetized with minimal magnetization variations and which is less costly. The present invention provides an electron beam adjusting device having pairs of two-, four- and six-pole ring-shaped magnets formed of an alnico metal system bonded magnet material, which are attached around the neck of a cathode-ray tube, wherein the two-pole ring-shaped magnets and the four- and six-pole ring-shaped magnets are made of respective bonded magnet materials which are different in the alnico metal magnetic powder content.

5 Claims, 5 Drawing Sheets

Fig.1
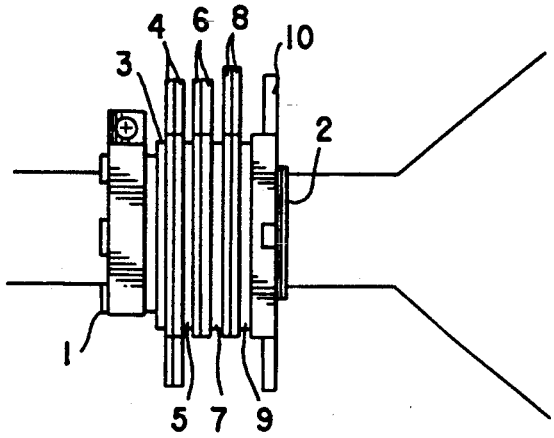
Fig.3(II)
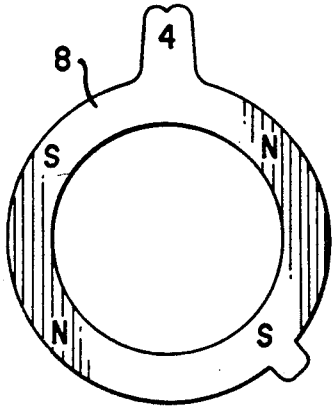
Fig.3(I)
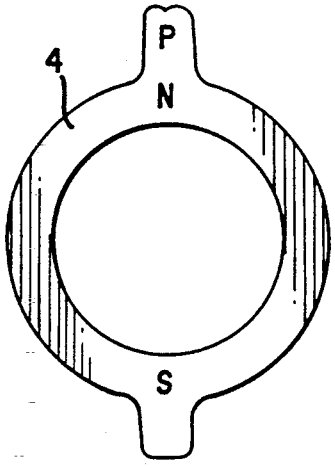
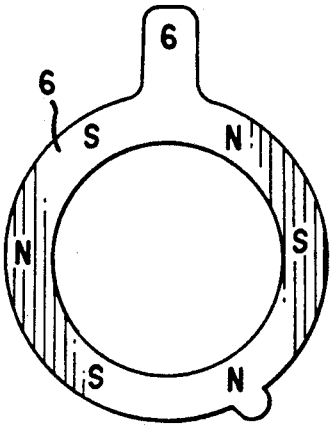
Fig.3(III)

ELECTRON BEAM ADJUSTING DEVICE WITH MAGNET RINGS OF DIFFERING ALNICO POWDERED METAL CONTENT

TECHNICAL FIELD

The present invention relates to an electron beam adjusting device which is attached around the neck of a color picture tube, a CRT display, etc.

BACKGROUND ART

The mainstream magnets used in color picture tubes to make electron beam adjustment are bonded magnets (resin-bonded magnets) comprising a magnetic powder, i.e., barium ferrite in general, which is bonded with a resin material. These bonded magnets suffer, however, from the problem that since the temperature coefficient is as large as about 0.2%/°C., the bonded magnets expand as the temperature rises, causing a reduction in the magnetization, so that undesirable color shift may occur. In color display tubes, the resolution is lowered by misconvergence due to the reduction in the magnetization. This is a fatal disadvantage to picture tubes having requirements for high definition. To solve this problem, it is conventional practice to use a bonded magnet material comprising a magnetic powder of low temperature coefficient, e.g., alnico magnetic powder, to form an electron beam adjusting device.

Incidentally, a minute observation of the action of two-pole magnets and that of four- and six-pole magnets reveals that the amount of beam shift made by the two-pole magnets is several times that by the four- or six-pole magnets. The reason for this is as follows: The two-pole magnets are used to make a color beam from each electron gun coincident with the axis of the picture tube, and it is also necessary to consider variations in production of picture tubes and the effect of the earth magnetism. Therefore, the amount of beam shift in the two-pole magnets is set to about 9 mm in radius. In contrast, for the four- and six-pole magnets, since these are used to converge the color beams in the center of the picture tube and the convergence of the color beams is mostly determined by the design of the electron guns, the amount of beam shift is set to about 3 mm in radius.

In view of the fact that the magnitude of beam shift is proportional to the magnetization of the magnet (i.e., the beam shift is about 1 mm to a magnetization of 1 G), it will be understood that it is sufficient and preferable to set the magnetization of the four- and six-pole magnets to a value lower than that of the two-pole magnets.

In regard to the magnetization characteristics of alnico magnetic powder, since the coercive force of this material is smaller than that of the conventional barium ferrite magnetic powder, it is difficult to control the level of magnetization for each pair of magnets. In particular, in the case of magnetization at low level, variations in the amount of magnetization are likely to occur, raising difficulty in making convergence adjustment; in the worst case, fatal problems arise, including a failure to effect the convergence adjustment.

In addition, since alnico magnetic powder is considerably costly as compared with barium ferrite magnetic powder, an increase in the alnico magnetic powder content leads to a rise in the production cost.

In view of the above-described circumstances, it is an object of the present invention to provide an electron beam adjusting device in which each pair of constituent magnets can be readily magnetized with minimal magnetization variations and which is less costly.

DISCLOSURE OF THE INVENTION

The present invention provides an electron beam adjusting device having pairs of two-, four- and six-pole ring-shaped magnets formed of an alnico metal system bonded magnet material, which are attached around the neck of a cathode-ray tube, wherein the two-pole ring-shaped magnets and the four- and six-pole ring-shaped magnets are made of respective bonded magnet materials which are different in the alnico metal magnetic powder content, thereby solving the problems of the conventional electron beam adjusting device in which all the magnets are made of a bonded magnet compound having a uniform alnico content.

In the electron beam adjusting device of the present invention, the alnico magnetic powder contents in the pairs of two-, four- and six-pole ring-shaped magnets are set in accordance with the amounts of magnetization required therefor, respectively, thereby making it possible to lower magnetization variations and minimize the amount of alnico magnetic powder used and hence possible to lower the production cost.

BRIEF DESCRIPTION OF THE DRAWINGS

FIG. 1 is a front view of one embodiment of the electron beam adjusting device according to the present invention;

FIGS. 3(I), 3(II) and 3(III) illustrate the arrangements of two-, four- and six-pole magnets, respectivelyp

BEST MODE FOR CARRYING OUT THE INVENTION

Figure 2:
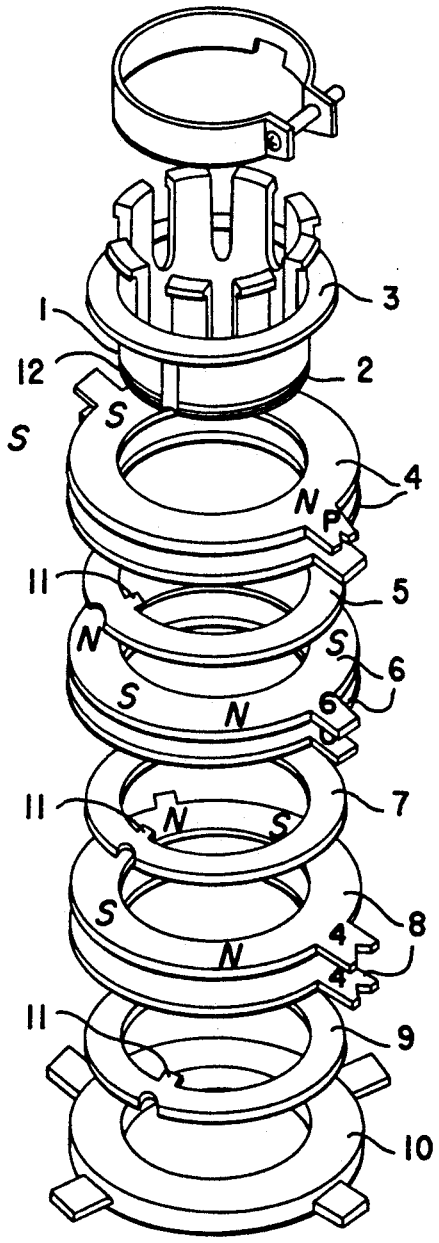
FIG. 2 is an exploded perspective view of the embodiment.

The electron beam adjusting device according to the present invention will be described below in detail by way of one embodiment illustrated in the drawings.

FIG. 1 is a front view of the electron beam adjusting device, and FIG. 2 is an exploded perspective view of the device. In these figures, a holder 1 made of a plastic material has a threaded portion 2 at one end thereof. The holder 1 also has a ring-shaped support 3 formed on its intermediate part as an integral part thereof. Onto the holder 1 are successively fitted a pair of two-pole ring-shaped magnets (purity magnets) 4, a ring-shaped spacer 5, a pair of ring-shaped six-pole magnets (convergence magnets) 6, a ring-shaped spacer 7, a pair of ring-shaped four-pole magnets (convergence magnets) 8, and a ring-shaped spacer 9 in the mentioned order, and finally, a lock ring 10 is brought into thread engagement with the threaded portion 2, thereby securing the magnets. It should be noted that when the lock ring 10 is untightened, the two-, four- and six-pole magnets on the holder 1 are rotatable for adjustment. In addition, the spacers 5, 7 and 9 have projections 11 formed on the respective inner edges and the projections 11 are engaged with a groove 12 provided on the holder 1 to prevent rotation of the spacers 5, 7 and 9.

In the above-described arrangement of the electron beam adjusting device, according to the present invention, a difference is made between the alnico magnetic powder contents in bonded magnet materials which are respectively used to form the two-pole magnets 4 and the six- and four-pole magnets 6 and 8. Thus, the alnico magnetic powder content of each pair of magnets is set in the light of the amount of magnetization required therefor, thereby facilitating the magnetization of each pair of magnets and eliminating magnetization variations. In particular, the alnico magnetic powder content in the bonded magnet material used to form the four- and six-pole magnets 8 and 6 is lowered to thereby stabilize the low-level magnetization of these magnets.

To confirm the results of the invention, the present inventors made two-pole magnets and four- and six-pole magnets using bonded magnet materials different in the alnico magnetic powder content, magnetized them, and measured the dependence on the magnetizing voltage, and further compared it with the magnetizing voltage dependence of conventional magnets all having the same alnico magnetic powder content. As an example of the present invention, the present invention formed a two-pole magnet 4 by using an alnico metal system bonded magnet compound having a relatively high alnico magnetic powder content, set to 60% by weight, and six- and four-pole magnets by using an alnico metal system bonded magnet compound having a relatively low alnico magnetic powder content, set to 30% by weight. As a comparative example, four- and six-pole magnets were made of an alnico metal system bonded magnet compound having an alnico magnetic powder content set to 60% by weight, together with a two-pole magnet made of an alnico metal system bonded magnet compound having an alnico magnetic powder content set to 30% by weight. In both the example of the invention and the comparative example, the two-, four- and six-pole magnet moldings had respective configurations (outer diameter: 45 mm; inner diameter: 33.5 mm; and thickness: 1.3 mm) such as those shown in FIG. 3, and each magnet molding was magnetized with a magnetizing yoke wound with 8 turns of a winding conductor having a diameter of 1.0 mm, using a power supply with a condenser capacitance of 500 $\mu$F, and with the charging voltage being varied, thereby measuring a curve representing the relationship between the charging voltage and the magnetic flux density. The results of the measurement are shown in FIG. 4.

Figure 4:
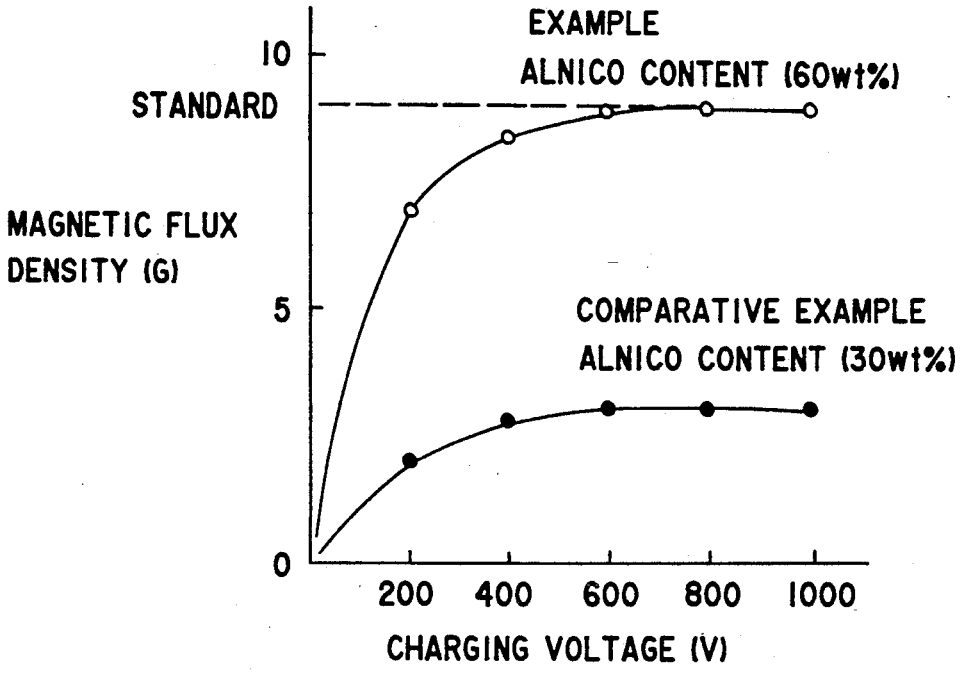
FIG. 4 is a graph showing the dependence of the magnetic flux density on the magnetizing voltage in the process of magnetizing two-pole magnets.
Figure 5:
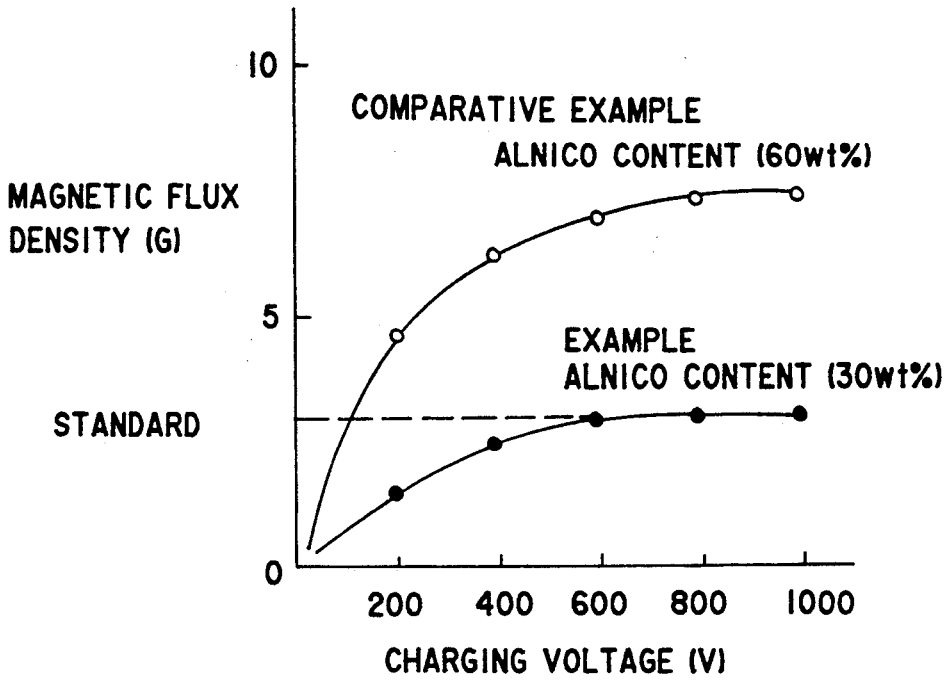
FIG. 5 is a graph showing the dependence of the magnetic flux density on the magnetizing voltage in the process of magnetizing four-pole magnets.
Figure 6:
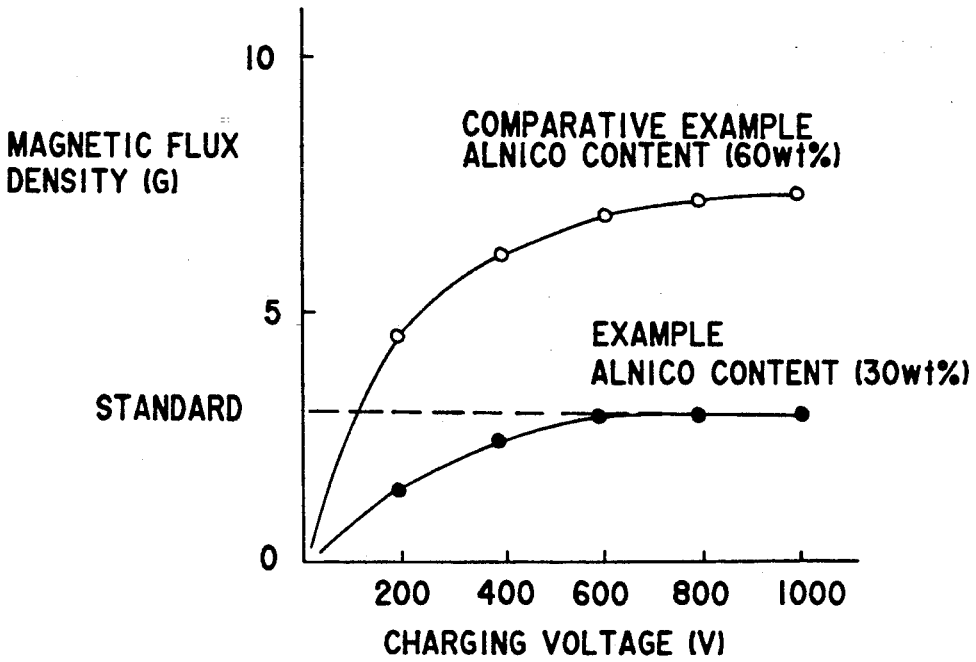
FIG. 6 is a graph showing the dependence of the magnetic flux density on the magnetizing voltage in the process of magnetizing six-pole magnets.

FIGS. 4, 5 and 6 each show the dependence of the magnetic flux density on the magnetizing voltage obtained on the basis of the measured values: FIG. 4 shows the magnetization curve of the two-pole magnets; FIG. 5 shows the magnetization curve of the four-pole magnets; and FIG. 6 shows the magnetization curve of the six-pole magnets. The curves shown by o in the figures represent the characteristics of the magnets having an alnico magnetic powder content of 60% by weight, whereas, the curves shown by • in the figures represent the characteristics of the magnets having an alnico magnetic powder content of 30% by weight. The point "standard" on the axis of ordinates shows the magnetic flux density required for each magnet. For the two-pole magnets, the standard magnetic flux density is defined as 9 G in the center of the magnet, whereas for the four- and six-pole magnets, it is defined as 3 G at a position 7.5 mm from the center of the magnet.

As will be clear from the graphs, since the alnico metal system bonded magnet compound has a small coercive force, when the high alnico content compound is used, the response of the magnetic flux-density to the change of the charging voltage is extremely steep in the low magnetic flux density region; therefore, in the case of magnetization of relatively low level as in the four- and six-pole magnets, slight supply voltage fluctuations lead to variations in the amount of magnetization, thus making it difficult to perform stable magnetization. In contrast, in the example of the present invention, in which the four- and six-pole magnets has a relatively low alnico magnetic powder content, the response of the magnetic flux density to the change of the charging voltage is extremely stable, so that it is possible to effect given magnetization under very stable conditions.

INDUSTRIAL APPLICABILITY

The present invention provides an electron beam adjusting device having pairs of two-, four- and six-pole ring-shaped magnets formed of an alnico metal system bonded magnet material, which are attached around the neck of a cathode-ray tube, wherein the alnico metal magnetic powder content in the bonded magnet material used for forming each pair of magnets is individually set in accordance with the amount of magnetization required therefor, and in particular, the alnico magnetic powder content in the bonded magnet material for forming the four- and six-pole magnets is set to a relatively low level, so that it is possible to magnetize the four- and six-pole magnets, which require a relatively low magnetization, under stable conditions without inviting magnetization variations. Moreover, since it is possible to minimize the amount of alnico magnetic powder (which is costly) used, an electron beam adjusting device can be obtained at lower cost. Thus, it is possible to provide an electron beam adjusting device which is particularly suitable for high definition picture tubes and picture tubes of large calorific value.

What is claimed is:

1. An electron beam adjusting device having pairs of two-, four- and six-pole ring-shaped magnets formed of an alnico metal system bonded magnet material having an alnico metal magnetic powder content, which are attached around the neck of a cathode-ray tube, wherein said two-pole ring-shaped magnets are made of bonded magnet materials which have a different wt % of the alnico metal magnetic powder than the wt % of the alnico metal magnetic powder of said four- and six-pole ring-shaped magnets.

2. An electron beam adjusting device according to claim 1, wherein the wt % of the Alnico metal magnetic powder in the two-pole ring-shaped magnets is greater than the wt % of the Alnico metal magnetic powder in said four- and six-pole ring-shaped magnets.

3. An electron beam adjusting device according to claim 2, wherein the four- and six-pole ring-shaped magnets have the same wt % of alnico metal magnetic powder.

4. An electron beam adjusting device according to claim 3, wherein said two-pole magnet has an alnico metal magnetic powder concentration of 60% by weight, and said four- and six-pole magnets each have an alnico metal magnetic powder concentration of 30% wt.

5. An electron beam adjusting device having pairs of two-, four- and six-pole ring-shaped magnets formed of an alnico metal system bonded magnet material having an alnico metal magnetic powder contents, which are attached around the neck of a cathode-ray tube, wherein said two-pole ring-shaped magnets are made of bonded magnet materials which are different in the alnico metal magnetic powder content, and wherein the alnico metal magnetic powder content in the bonded magnet material for forming said two-pole magnets is at least 30% by weight higher than the alnico metal magnetic powder content in the bonded magnet material for forming said four- and six-pole magnets.

* * * * *